United States Patent [19]

Christmann et al.

[11] Patent Number: 4,545,420

[45] Date of Patent: Oct. 8, 1985

[54] APPARATUS FOR DETERMINING MOLD WALL WEAR DURING CASTING AND FOR DETERMINING SHRINKAGE OF THE CASTING FROM THE INNER WALL OF THE MOLD

[75] Inventors: Burkhard Christmann; Jörg Weber, both of Berlin; Gerhard Stadtfeld, Duisburg, all of Fed. Rep. of Germany

[73] Assignees: Licentia Patent-Verwaltungs-GmbH, Frankfurt; Mannesmann Aktiengesellschaft, D/ sseldorf, both of Fed. Rep. of Germany

[21] Appl. No.: 589,676

[22] Filed: Mar. 15, 1984

[30] Foreign Application Priority Data

Mar. 16, 1983 [DE] Fed. Rep. of Germany ..... 3309885

[51] Int. Cl.[4] ..... B22C 19/04

[52] U.S. Cl. ..... 164/150; 164/435

[58] Field of Search ..... 164/451, 452, 491, 150, 164/154, 418, 435, 436

[56] References Cited

U.S. PATENT DOCUMENTS 4,027,233 5/1977 Shmakov et al. ..... 164/154
4,413,667 11/1983 Schrewe et al. ..... 164/436

FOREIGN PATENT DOCUMENTS 3110012 11/1982 Fed. Rep. of Germany ..... 164/436
57-127559 8/1982 Japan ..... 164/451
57-171554 10/1982 Japan ..... 164/452
58-163561 9/1983 Japan ..... 164/451
914173 3/1982 U.S.S.R. ..... 164/150

OTHER PUBLICATIONS

B. Christmann and J. Weber, "Eddy Current Measuring Devices for Automatic Detection of Material Defects in Strands During the Casting Process", 9th IMEKO World Conference, (Berlin, May 24–28, 1982), pp. 59–65.

*Primary Examiner*—Nicholas P. Godici
*Assistant Examiner*—G. Reid
*Attorney, Agent, or Firm*—Spencer & Frank

[57] ABSTRACT

An apparatus for determining the wear of a mold wall during continuous casting of metal by using at least one distance measuring sensor disposed in the mold wall to measure the instantaneous distance from the sensor to the casting. The surface of the casting adjacent the mold wall may be irregular, so the minimum value of the distance between the sensor and casting is stored and used as the current distance between the sensor and the inner mold wall. Mold wear is determined by subtracting the current distance between the sensor and the inner mold wall from the original distance, before the abrasive casting process began. The sensor signals are also used to determine when the mold geometry should be adjusted to compensate for the wear. This is accomplished by storing the maximum distance between the sensor and casting and subtracting the current distance from this maximum, since the maximum distance increases as the casting shrinks away from the mold wall.

13 Claims, 5 Drawing Figures

APPARATUS FOR DETERMINING MOLD WALL WEAR DURING CASTING AND FOR DETERMINING SHRINKAGE OF THE CASTING FROM THE INNER WALL OF THE MOLD

BACKGROUND OF THE INVENTION

The present invention relates to a apparatus for determining the wear on mold walls during continuous casting of metals, and to the use of such an apparatus for determining the shrinkage of the casting shell from the inner wall of the mold.

In continous metal casting, the casting is produced by continuously casting liquid material through a chute in the mold. The walls of the chute, which ay be fabricated from copper, are frequently cooled to facilitate absorption of heat from the casting as it moves through the chute. When exiting from the chute, the casting has a solid shell and a liquid core. Further cooling after the casting leaves the chute results in complete solidification.

Friction between the casting and the chute walls results in wear of the walls (this occurs at the rate of about 0.5 mm in 10 hours of operation in the casting of steel slabs). If the resulting reduction in the thickness of the chute walls exceeds a system specific limit value (e.g. 10 mm), the mold must be exchanged. At present, the reduction in wall thickness is determined during intervals between castings. However the maximum casting periods have increased substantially in recent years, so that a determination of the wear during the casting process itself is of great significance. Such a determination is hindered by the "lifting" of the casting from the mold walls, which varies with time and positon within the chute. This lifting is caused by shrinkage of the cross section of the casting due to cooling of its shell upon contact with the cooled mold walls. After the shell of the casting has lifted itself away from the mold walls, it is heated again due to the influx of heat from its liquid core, causing the shell to expand until it comes back into contact with the cooled chute wall again. This process may be repeated several times in one casting cross section while it passes through the mold, with the location and amount of shrinkage in the chute varying over time. The gaps produced between the chute wall and casting as a result of the shrinkage are sometimes filled with casting powder, particularly if the shrinkage is slight. In addition to the local variations in shrinkage which produce the lifting phenomenon, there is also a progressive shrinkage as the casting continues to cool while moving through the chute. This reduces the average cross-sectional dimensions of the casting.

The reduction in cooling of the casting due to shrinkage weakens shell growth in the mold and may produce disturbances in the casting process; in particularly serious cases breaks may occur in the casting. For that reason, the mold chute is given a tapered shape, such as a conical shape if a rod of circular cross section is being cast, in order to accommodate the shrinkage of the casting as it cools while moving through the chute. The amount of taper is a critical parameter. If it is too slight, the reduction in cooling due to shrinkage may become too great because of inadequate contact with the cooling walls of the chute, while if it is too great, friction between the casting and chute walls in the lower chute region may become too great. For the majority of the casting programs, empirical values are available which permits satisfactory casting procedures. When such casting programs are used continuous checking of the wear of the chute walls, and possibly readjustment of the walls to compensate for such wear, are of great significance. For particularly critical casting tasks, however, measurements of the amount of lifting in the mold and setting of the taper according to such values are necessary. This is particularly applicable for greatly varying casting speeds. Measurement of the amount of lifting has not been possible in the past.

German Offenlequngschrift No. 3,110,012 discloses an arrangement in which a sensor below, and thus outside of, the mold determines changes in the distance to the casting surface. In dependence on these changes, the taper of the mold is adjusted during the casting process. However, this arrangement does not detect wear of the mold walls. Therefore, optimum adjustment of the taper is impossible. Moreover, problems must be expected due to expansion of the casting after it leaves the mold so that no clear distinction can be made as to whether a change in the distance between the casting surface and the sensor is the result of a change in casting shrinkage while the casting is in the mold or whether such a change is the result of deformation of the casting outside the mold.

SUMMARY OF THE INVENTION

It is a primary object of the present invention to provide an apparatus with which the wear of the mold walls can be determined during the casting process, the result also providing an indication of the lifting of the casting from the walls so that the chute taper can be adjusted.

These objects can be attained by installing at least one distance measuring sensor in the chute mold walls in order to find the distance from the sensor to the casting. Abrasion of the mold wall is found by subtracting the current distance from the sensor to the inner mold wall from the original distance, the current distance being determined on the basis of the minimum detected instantaneous distance between the sensor and casting in order to avoid erroneous results when a casting lift occurs adjacent the sensor. In order to permit adjustment of the mold taper, the amount of lifting of the casting is determined on the basis of the minimum detected distance and the instantaneous distance.

DESCRIPTION OF THE PREFERRED EMBODIMENTS

Figure 1:
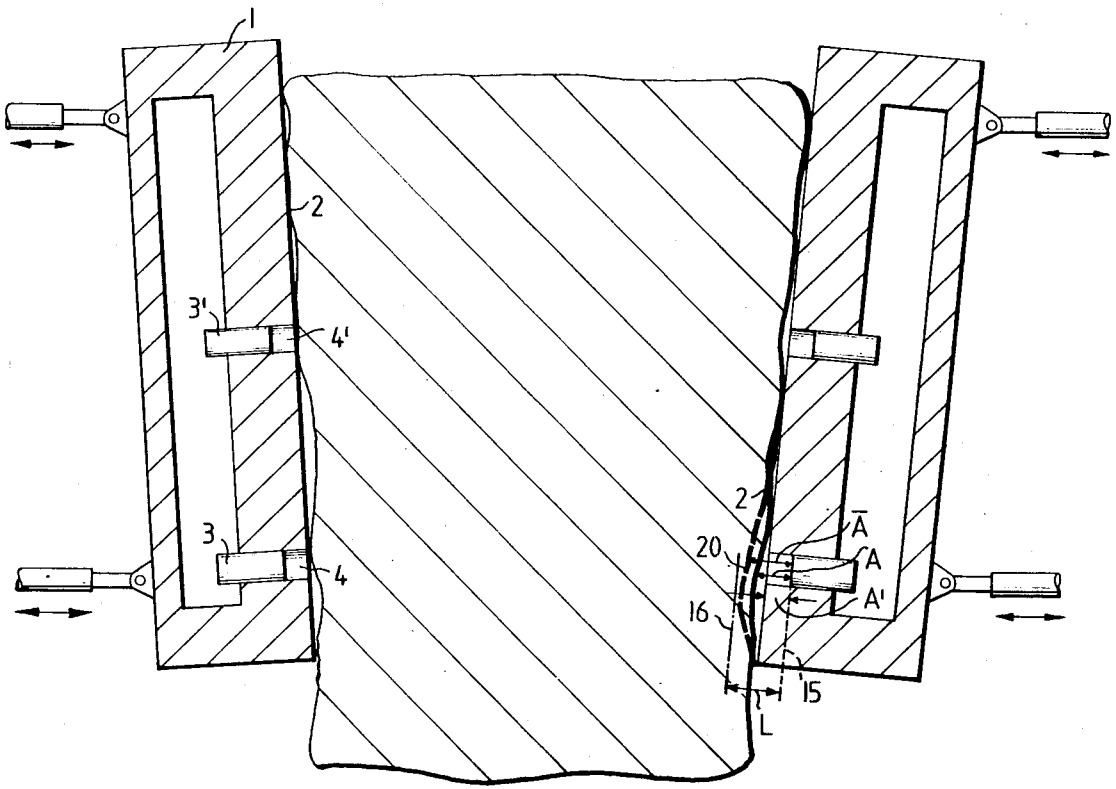
FIG. 1 is a view illustrating the chute portion of a mold with measuring sensors disposed in bores.

In FIG. 1, eddy current distance measuring sensors 3 and 3' are mounted in bores 4 and 4' through a chute wall 1 of the mold. The sensors are installed at positions that are recessed from the inner wall of the chute so that, even with the maximum permittd wear of the mold walls, the sensors will not touch the surface 2 of the casting. In a mold that has not yet been used, the distance between the inner surface of the chute and the sensors can be determined during installation of the sensors and is known. Let this original distance be L, which corresponds to a mold wear of zero, or no wear. In FIG. 1 arrow L is illustrated between dotted line 15, which indicates the depth of a sensor in the mold wall, and dot-dash line 16, which indicates (in exaggerated form) the original surface of the mold wall before wear began. During casting, each distance measuring sensor determines the instantaneous distance A of the casting surface from the sensor. In order to eliminate the influence of the lifting phenomenon, which temporarily separates the casting surface 2 from the inner wall of the chute, the instantaneous distance A detected by a sensor is provided to an associated minimum value memory which stores the lowest measured value it receives while erasing the last previouly stored value. The wear of the chute wall is determined based upon the value A' stored in the minimum value memory, as follows:

$$\Delta L = L - A'$$

The $\Delta L$ values permit a conclusion as to when the mold must be exchanged or when an ongoing casting process must be terminated for this purpose.

The sensors employed need not be highly accurate for every possible distance to the surface of the casting. Instead, it is only necessary that they be sufficiently accurate within a range of critical wear, illustrated in FIG. 2 as the region between dotted lines 10 and 10', encountered shortly before the mold must be exchanged. This permits a smaller and simpler configuration 5 for the eddy current measuring sensors. Moreover, the measuring sensor opening 6 need only be deep enough so that the wall material (usually copper) between measuring sensor 5 and the surface of the casting will be used up only when the wear values are critical.

Figure 2:
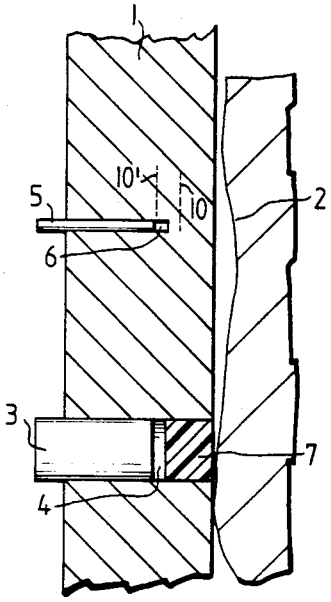
FIG. 2 illustrates a portion of a mold wall having a measuring sensor in a through bore and a measuring sensor which measures in the region of critical wear.

In order for the casting not to be mechanically stressed by bore 4 in the mold wall, the space between the surface of sensor 3 and the mold wall in FIG. 2 is filled with a nonmagnetic, electrically nonconductive material 7 which has mechanical wear properties similar to those of the mold wall. Suitable materials for this purpose include the softer metal oxides and metal carbonates, such as, for example, unburned stummatite.

A significant improvement in the casting process can be realized by moving the chute walls to meet the desired geometry of the chute on the basis of the measured wear values, using an adjustment device which displaces the mold walls according to these values. With the aid of suitably arranged measuring sensors 3 and 3', as shown in FIG. 1, it is possible in this way, particularly in slab casting systems, to maintain the taper of the mold chute at the required value, a factor of primary importance for the process sequence.

The apparatus for determining mold wall wear according to the present invention can be used to determine the amount of lifting of the casting shell from the inner mold wall. To do this the amount of lifting $\Delta A = A - A'$ of the casting surface from the inner mold wall is determined from the difference between the instantaneous distance A that is actually measured between the measuring sensor and the casting surface and the stored, smallest distance value A'. The lifting values are used to obtain a characteristic value which is provided to the above-mentioned adjusting device for correspondingly adjusting the mold walls. This characteristic value is determined by storing the maximum of the lifting values $\Delta A$.

A measuring sensor (not illustrated) disposed immediately below the mold is used to observe the deformation of the casting shell after leaving the mold. This deformation depends primarily on the casting removal speed and on the contact between the casting and the inner mold walls, and thus on the taper of the mold walls.

Since the danger that flaws may develop in the casting shell or even that the casting shell may break open increaseswith the degree of deformation, the taper should be decreased and possibly the casting removal speed should be decreased if the deformation is too great. Some systems states—such as, for example, the beginning of the casting process or casting at very slow speeds—place requirements on the adjusting device that are different from the requirements during normal, steady operation. Therefore, the desired values for the adjustment of the mold walls during some or all of the system states may be determined with the aid of a computer from the values measured by the apparatus, with such system parameters as length of casting and removal speed also being relevant in this respect.

Figure 3:
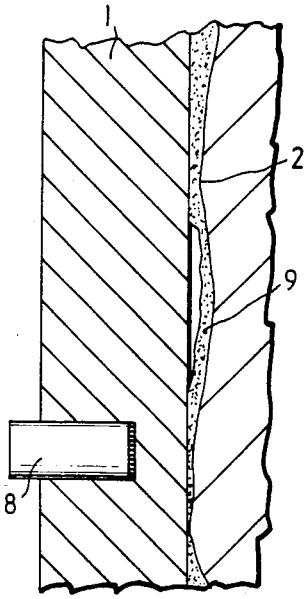
FIG. 3 illustrates an embodiment which employs an ultrasonic senor disposed in the mold wall.

The embodiment shown in FIG. 3 employs ultrasonic sound sensors. The measuring heads 8 are coupled directly to mold wall 1. The system operates according to the pulse echo process. Wear of the mold wall is determined from the travel time of a sound pulse that is emitted from head 8 and reflected at the surface of the chute back to head 8. The reflection is influenced by the casting surface and by the layer of lubricant 9 between the casting surface and the chute surface and may sometimes be received after a very short delay. Therefore—in a manner analogous to the preceding embodiment—a minimum value is stored. A determination of casting shrinkage by means of sound is possible if the space between casting surface and chute is completely filled with casting powder. Some of the sound is then able to pass through the mold wall and the sensor is able to detect an echo from the reflection at the surface of the casting. The time interval between the echo of the partial reflection of the sound pulse and the mold wall and the echo at the casting surface depends on the amount of lifting.

As will be apparent from the foregoing discussion, one or more sensors disposed in the chute mold walls and spaced apart from the casting can be used to help solve a pair of closely related problems that arise due to the abrasive environment encountered during continuous casting of metals. One of these problems is the problem of determining mold wear so that the mold can be exchanged before the wear progresses too far; this problem is complicated by the lifting phenomenon which results in occasional gaps between the casting and the mold wall. That is to say, sometimes the casting is closely adjacent to a given point on the mold wall while at other times it is spaced apart from the given point. Nevertheless at times the casting is in contact with the mold wall, except perhaps for a thin layer of lubricant, and at these times the distance between the casting and a sensor is at a minimum. Accordingly, continuous storing of the minimum distance between a sensor and the casting is tantamount to storing the current distance between the sensor and the mold wall. Mold wear $\Delta L$ at any particular time can be determined by subtracting the current minimum distance A' from the original distance L from the sensor to the mold wall. Moreover, one or more distance sensors disposed in the mold wall and spaced apart from the casting, can also be used to solve a related problem that arises as a result of mold wear. Since the mold walls convey heat from the casting, a suitable mold geometry must be maintained so that shrinkage of the casting away from the mold wall does not hamper heat transfer. Although the gaps produced by the lifting phenomenon are not uniform, it will be apparent that the distance between the inner mold wall and the summit of a gap (identified by reference number 20 in FIG. 1) tends to increase as a mold wears. That is, the distance between the minimum value A' and the instantaneous value A tends to increase, even though the individual gaps themselves are not uniform. Such increased wear effectively decreases the total area of contact between the casting and the cooled mold walls, and is therefore detrimental. This detrimental effect can be avoided by moving the mold wall so as to maintain a proper chute geometry and taper when the maximum gap distance exceeds a predetermined value that is greater than the largest value produced by the lifting phenomenon when the mold was new.

Figure 4:
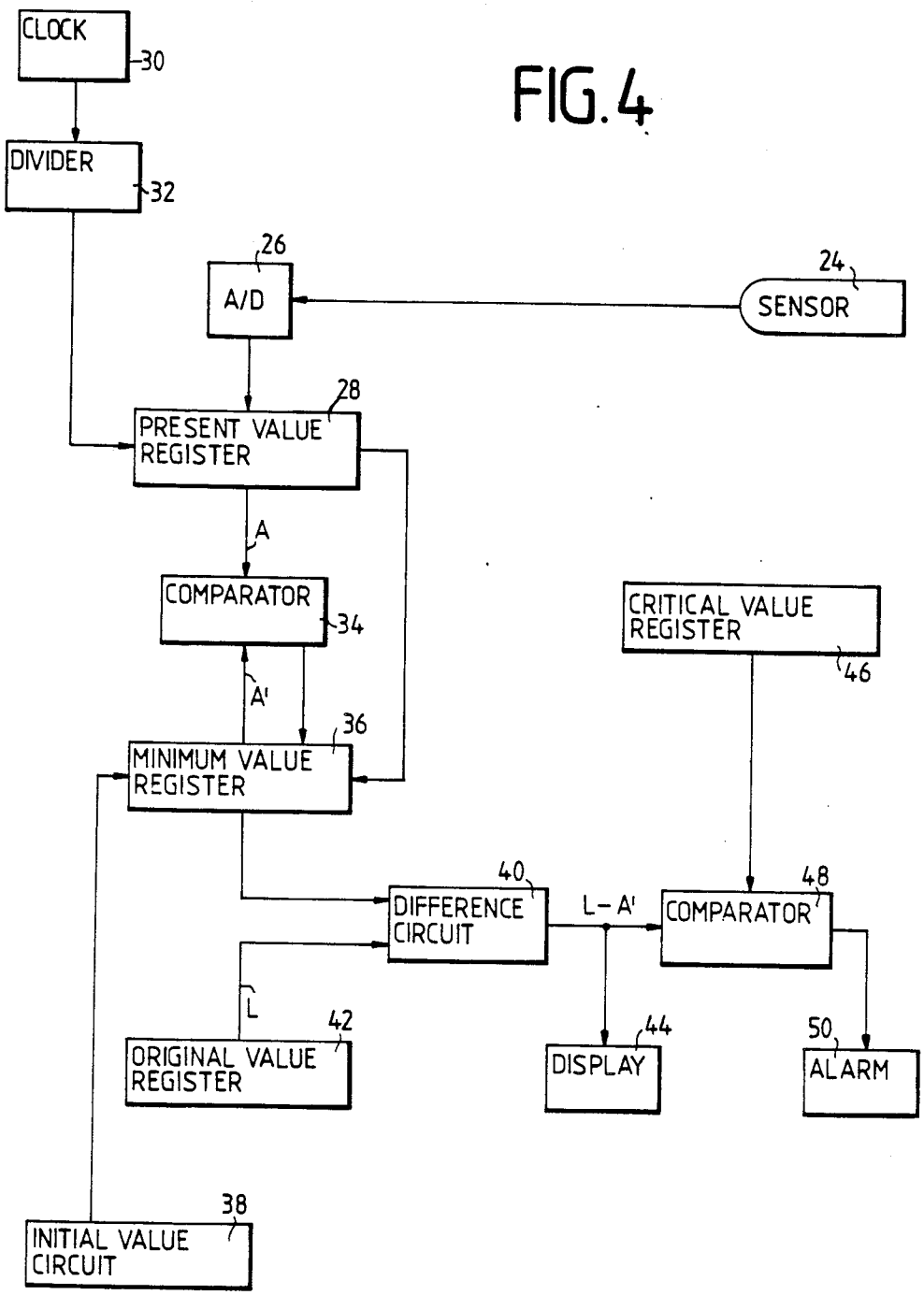
FIG. 4 is a schematic block diagram of a system for determining mold wear.

With reference to FIG. 4, sensor 24 continuously generates a signal indicating the current distance from the sensor to the casting. This distance signal is provided to digital-analog converter 26, which emits a digital signal corresponding to the instantaneous distance to present value register 28. Clock 30 provides a clock signal to divider 32, which frequency-divides the clock signal to provide a periodic signal for enabling register 28, so that register 28 samples the digital value from converter 26 at regular intervals. Comparater 34 compares the magnitude of the content of present value register 28 with the magnitude of the content of minimum value register 36, and provides an enable signal permitting the content of register 28 to be copied into register 36 in the event that the value contained within register 28 is smaller than the value stored by register 36. It should be noted that the output of present value register 28 corresponds to the current distance value A, while the output of register 36 corresponds to minimum distance signal A'.

With continuing reference to FIG. 4, it will be apparent that a content of "000 . . . 0" in register 36 when the circuit is energized and operation begins would result in erroneous operation, since the present value in register 28 would never be transferred to register 36. Accordingly, initial value circuit 38 loads "111 . . . 1" into register 36 when the casting operation begins and the circuity is energized. The same value is also loaded into register 36 following each readjustment of the mold walls. Accordingly, at start-up and at each renewal of operation, register 36 contains a high value, and progressive wear of the mold walls during operation reduces the magnitude of the value stored in register 36. The output of register 36 is provided to difference circuit 40, which also receives the output of original value register 42. Before operation begins the digital value corresponding to L, the distance between sensor 24 and the mold wall while new, is loaded into register 42. Accordingly, the output of circuit 40 represents L−A', a digital value indicating mold wear. The signal is provided to display 44, such as a digital panel meter, in order to present a continuing indication of mold wear. Before operation begins a value corresponding to maximum acceptable mold wear is loaded into critical value register 46. With reference to FIG. 2, this value would correspond to the distance between the face of sensor 5 and a region between dotted lines 10 and 10'. Comparator 48 compares the magnitudes of the outputs of difference circuit 40 and regiser 46, and provides a signal to alarm 50 when the wall wear exceeds the value stored in register 46. The alarm may be a visual one or a bell, or it may simply be an electrical signal indicating that casting operation should be discontinued. It will be apparent to those skilled in the art that the function of the system of FIG. 4, as described herein, could be performed by computer rather than hard-wired circuitry.

A second problem is the adjustment of the taper of the mold. The number and arrangement of the sensors for such an adjustment depends on the technological conditions in the respective system. One embodiment is shown in FIG. 1, where the taper is monitored by means of two sensors 3 and 3'. Sensor 3' is installed at one-half the mold length and sensor 3 is installed at the lower end of the mold. These sensors measure the respective instantaneous distance A. At normal casting speeds (about 1 m/minute) the mold might typically be adjusted to avoid lifting at the location of sensor 3' and to set a minimum lift of, e.g., 0.3 mm at the location of sensor 3.

When the casting speed is reduced, cooling of the casting is increased because the casting remains in the mold longer. Such increased cooling is undesirable because surface cracks may develop. For that reason, the mold adjustment might provide a greater amount of lifting at the location of sensor 3 and possibly some lifting at the location of sensor 3'. For good optimization of the taper at slower casting speeds, it may be necessary to increase the number of sensors employed. This is particularly applicable if there is repeated alternation between the casting lifting away from the mold walls and recontacting them again.

Figure 5:
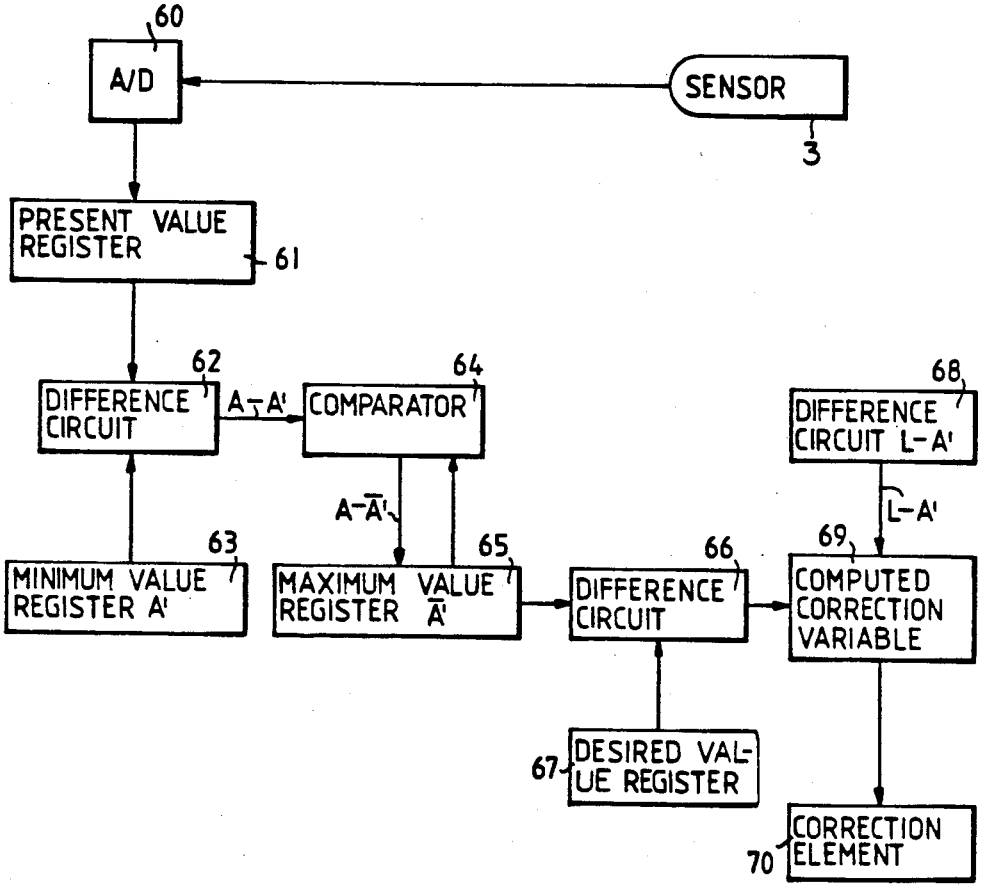
FIG. 5 is a schematic block diagram of a system for adjusting the taper.

In FIG. 5, sensor 3 continuously furnishes a signal corresponding to the actual distance between sensor 3 and the casting surface, and the signal is provided to an A/D converter 60. The output of A/D converter 60 is supplied to present value register 61. The outputs of minimum value register 63 and register 61 are supplied to difference circuit 62. There the amount of lifting A−A' is determined and applied to a comparator 64. Comparator 64 examines whether the actual value of lifting is greater than the maximum value of earlier measurements stored in maximum value ($\overline{A'}$) register 65. If the new value is greater, it is stored in register 65. The maximum value of lifting from register 65 and the contents of desired value register 67 are provided to difference circuit 66. The output signal of circuit 66 and the amount of wear of the mold wall from difference circuit (L−A') 68 are supplied to register 69, where the setting value for the taper is determined. This setting value is supplied to an adjustment device 70. The adjustment device is a commercially available device manufactured, for example, by Mannesmann-Demag (Conti-Mould).

Eddy current sensors suitable for use under casting conditions are known (B. Christmann, J. Weber, IMEKO, Berlin, 1982, Preprint V/V, page 59). When working with ultrasonic sound, conventional sensors employing piezoelectric transducers, for example those made by Krautkrämer, can be used in principle.

What we claim is:

1. An apparatus for determining the wear of mold walls during a casting process in which a casting moving through the interior of the mold occasionally lifts itself away from the mold walls, comprising:

at least one distance measuring sensor installed in one of the mold walls at a position wherein it will not contact the casting even if the mold wall has been worn off during operation, said at least one sensor providing a distance signal corresponding to one of the distance from the surface of said one of the mold walls to said at least one sensor and the distance from the casting to said at least one sensor;

minimum value memory means operatively connected to said at least one sensor for storing a value corresponding to the distance signal produced by said at least one sensor when the distance from the casting to said at least one sensor is at a minimum, and for erasing the previous value stored; and mold wall wear determination means operatively connected to said minimum value memory means for determining the difference between the value stored by said minimum value memory means and an initial predetermined value corresponding to the distance between said at least one sensor and the surface of said one of the mold walls before mold wear began.

2. The apparatus of claim 1, wherein said distance signal corresponds to the distance from the surface of said one of the mold walls and said at least one sensor, and further comprising shrinkage determination means operatively connected to said minimum value memory means for finding the amount of shrinkage of the casting from the surface of said one of the mold walls, said shrinkage determination means including means operatively connected to said minimum value memory means for determining the difference between said distance signal of said at least one sensor and the value stored by said minimum value storage means.

3. The apparatus of claim 1, wherein said at least one sensor is an eddy current sensor, said distance signal corresponding to the distance from the surface of said one of the mold walls and said at least one sensor.

4. The apparatus of claim 3, wherein said one of the mold walls has an opening therein for accommodating said at least one sensor, said opening being configured so that only material that transmits high frequency fluctuations of a magnetic field is disposed between said at least one sensor and the casting.

5. The apparatus of claim 4, wherein the opening for accommodating said at least one sensor opens into the interior of the mold, and further comprising material sealing the opening that is non-magnetic and electrically non-conductive, and that has approximately the same resistance to wear as said one of the mold walls, said material having a surface facing the casting that substantially conforms to the adjacent surface of said one of the mold walls.

6. The apparatus of claim 2, wherein said at least one sensor is an eddy current sensor.

7. The apparatus of claim 6, wherein said one of the mold walls has an opening therein for accommodating said at least one sensor, said opening being configured so that only material that transmits high frequency fluctuations of a magnetic field is disposed between said at least one sensor and the casting.

8. The apparatus of claim 7, wherein the opening for accommodating said at least one sensor opens into the interior of the mold, and further comprising material sealing the opening that is non-magnetic and electrically non-conductive, and that has approximately the same resistance to wear as said one of the mold walls, said material having a surface facing the casting that substantially conforms to the adjacent surface of said one of the mold walls.

9. The apparatus of claim 1, wherein said at least one sensor is an ultrasonic sensor.

10. The apparatus of claim 2, wherein said at least one sensor is an ultrasonic sensor.

11. The apparatus of claim 1, wherein the mold is adjustable and said one of the mold walls is a displaceable wall, and further comprising adjustment device means communicating with said displaceable wall for displacing it by an amount corresponding to the mold wear.

12. The apparatus of claim 2, wherein said mold is adjustable and wherein said shrinkage determination means comprises means operatively connected to said minimum value means for determining a characteristic value corresponding to the amount of shrinkage, and further comprising means responsive to said characteristic value for adjusting at least said one of the mold walls.

13. The apparatus of claim 12, wherein said means for determining a characteristic value comprises means operatively connected to said minimum value means for storing the maximum shrinkage value.

* * * * *